US010777373B2

(12) United States Patent
Lebreton et al.

(10) Patent No.: US 10,777,373 B2
(45) Date of Patent: Sep. 15, 2020

(54) FOOT PEDAL FOR CONTROLLING A MEDICAL DEVICE

(71) Applicant: FERTON HOLDING S.A., Delémont (CH)

(72) Inventors: Etienne Lebreton, Crissier (CH); Florent Jean-Claude Georges Beani, Gex (FR)

(73) Assignee: FERTON HOLDING S.A., Delémont (CH)

( * ) Notice: Subject to any disclaimer, the term of this patent is extended or adjusted under 35 U.S.C. 154(b) by 0 days.

(21) Appl. No.: 16/338,545

(22) PCT Filed: Sep. 14, 2017

(86) PCT No.: PCT/EP2017/073181
§ 371 (c)(1),
(2) Date: Apr. 1, 2019

(87) PCT Pub. No.: WO2018/059960
PCT Pub. Date: Apr. 5, 2018

(65) Prior Publication Data

US 2020/0043682 A1 Feb. 6, 2020

(30) Foreign Application Priority Data

Sep. 30, 2016 (DE) ..... 10 2016 118 602

(51) Int. Cl.
*H01H 21/26* (2006.01)

(52) U.S. Cl.
CPC ..... *H01H 21/26* (2013.01); *H01H 2217/01* (2013.01); *H01H 2221/044* (2013.01);
(Continued)

(58) Field of Classification Search
CPC ..... H01H 21/26; H01H 2221/08; H01H 2227/032; H01H 2300/024; H01H 2239/03; H01H 2217/01; H01H 2221/044
(Continued)

(56) References Cited

U.S. PATENT DOCUMENTS 3,663,772 A 5/1972 Grabel
3,980,848 A * 9/1976 Schulz ..... H01H 3/14 200/86.5

(Continued)

FOREIGN PATENT DOCUMENTS

DE 6603334 U 9/1969
DE 2814869 A1 10/1979
DE 202006015718 U1 1/2007

OTHER PUBLICATIONS

International Search Report for corresponding application PCT/EP2017/073181 filed Sep. 14, 2017; dated Jan. 15, 2018.

(Continued)

*Primary Examiner* — Edwin A. Leon
*Assistant Examiner* — Lheiren Mae A Caroc
(74) *Attorney, Agent, or Firm* — Cantor Colburn LLP

(57) ABSTRACT

A foot pedal for controlling a medical device, in particular a dental device, including a housing with a housing base, a cover element which is mounted so as to be vertically displaceable with respect to the housing base along an actuating direction and so as to be inclinable with respect to the housing base, a first switch for initiating a first functionality on the medical device and a second switch for initiating a second functionality on the medical device, and an actuating device which is vertically displaceable along the actuating direction and which actuates the first switch during a movement in the actuating direction within a first height offset section and actuates the second switch within a second height offset section, the actuating device being
(Continued)

configured in such a way, in that it is in a first state in the first height offset section and in a second state in the second height offset section, where the foot pedal being configured such that, at a predeterminable angle of inclination of the cover element, the actuating device is always arranged within the first height offset section.

9 Claims, 3 Drawing Sheets

(52) U.S. Cl.
CPC ... *H01H 2221/08* (2013.01); *H01H 2227/032* (2013.01); *H01H 2239/03* (2013.01); *H01H 2300/024* (2013.01)

(58) Field of Classification Search
USPC ..... 200/86.5
See application file for complete search history.

(56) References Cited

U.S. PATENT DOCUMENTS

| | | | | |
|---|---|---|---|---|
| 7,439,462 | B2 | 10/2008 | McCoy | |
| 7,439,463 | B2 | 10/2008 | Brenner | |
| 2009/0272221 | A1 | 11/2009 | Long | |
| 2010/0230259 | A1* | 9/2010 | Jo | G05G 1/30 200/86.5 |
| 2014/0038129 | A1 | 2/2014 | Lint | |

OTHER PUBLICATIONS

International Search Report for corresponding application PCT/EP2017/072693 filed Sep. 11, 2017; dated Mar. 26, 2018.
International Preliminary Report on Patentability for corresponding application PCT/EP2017/072693 filed Sep. 11, 2017; dated Apr. 11, 2019.
International Preliminary Report on Patentability for corresponding application PCT/EP2017/073181 filed Sep. 14, 2017; dated Apr. 11, 2019.

* cited by examiner

FOOT PEDAL FOR CONTROLLING A MEDICAL DEVICE

TECHNICAL FIELD

This disclosure concerns a foot pedal for controlling a medical device, in particular a dental device.

BACKGROUND

Such foot pedals are well known from the state of the art, for example from the U.S. Pat. No. 7,439,462, and are intended to provide a treating physician during treatment with a room for maneuver that allows him to continue treatment without interrupting it for manual modifications to the medical device. Instead of interrupting the treatment, he makes modifications to the medical device using the foot pedal. Essential components of the foot pedal are a housing with a housing base and a cover element which is height-adjustable in relation to the housing base along an actuating direction and which is usually also inclinably or tiltably mounted. Typically, the cover element rests on an actuating device arranged centrally below the cover element and displaceable along the actuating direction, so that the cover element can also be tilted to either side (see DE 20 2006 015 718 U1). Here the actuating device serves as a lever point or lever surface.

In order to induce different functionalities on the medical device with the foot, it is desirable that stepping on the edge area of the cover element is assigned to a first functionality of the medical device and a stepping on a central area of the cover element is assigned to a second functionality of the medical device different from the first functionality. In order to be able to distinguish between these two types of actuation, the actuating device is mounted in a height-adjustable manner, wherein the height offset of the actuating device is caused both when stepping on the edge area and when stepping on the central area. The height offset of the actuating device when stepping on the edge area is supported by the fact that during tilting the movement of the cover element on the side opposite to the actuated edge area is limited upwards, i.e. in a direction opposite to the direction of actuation.

Assuming the same force size, however, a force acting on the edge area leads to a smaller height offset of the actuating device than a central force acting on the cover element, in particular directly above the actuating device usually located in the central area. Accordingly, a differentiation can be determined on the basis of the respective size of the height offset. Therefore, in the U.S. Pat. No. 7,439,462, a first switch for initiating a first functionality of the medical device and a second switch for initiating a second functionality of the medical device are configured such that the first switch in a first height offset section and the second switch in a second height offset sections following the first height offset portion can be operated one after the other by the actuating means moving in the direction of actuation.

However, this does not prevent a user of the foot pedal from exerting so much force when actuating the cover element at the edge that the actuating device imperceptibly reaches the second height offset section and thus inadvertently triggers the second functionality.

BRIEF SUMMARY

The disclosure provides a foot pedal to control a medical device wherein the probability of accidental triggering the second functionality can be reduced compared to the state of the art.

According to the disclosure, a foot pedal for controlling a medical device is provided, in particular a dental device, comprising

- a housing with a housing base,
- a cover element which is mounted so as to be vertically displaceable with respect to the housing base along an actuating direction and so as to be inclinable with respect to the housing base,
- a first switch for initiating a first functionality on the medical device and a second switch for initiating a second functionality on the medical device, and
- actuating device which is vertically displaceable along the actuating direction and which actuates the first switch during a movement in the actuating direction within a first height offset section and actuates the second switch within a second height offset section, wherein the actuating device is configured to be in a first state, e.g. in a pushed apart state, in the first height offset section and in a second state, e.g. a pushed together state in the second height offset section, wherein the foot pedal is configured such that at a predeterminable angle of inclination of the cover member the actuating device is always within the first state, i.e. disposed within the first height offset portion.

According to a preferred embodiment of the present disclosure, the predeterminable angle of inclination is the maximum possible angle of inclination of the cover element, which is defined on one side by an at least partial contact of the cover element with the housing base and on the opposite side by contact of the cover element with at least one radial projection of the housing which projects radially outwards and prevents the cover element from lifting upwards. However, the predeterminable angle of inclination is usually an angle range between a first angle and the maximum possible angle, e.g. between 5° and 15°, preferably between 6° and about 10°.

Compared to the state of the art, it is provided in accordance with the disclosure that the operation of the second switch is made more difficult by the fact that, on the one hand, the operating device must be transferred to the second state before it can reach the second height offset section and, on the other hand, the foot pedal is configured or dimensioned in such a way that the operating device remains exclusively within the first height offset section when the cover element has reached a maximum possible angle of inclination. The latter deprives the actuator of the ability to make the transition to the second condition at all so as to move to the second height offset section when the cover member has reached a maximum possible angle of inclination. This advantageously reduces the probability of unintentionally triggering the second functionality, especially if a user is acting with his foot on the edge area of the cover element.

In particular, the foot pedal is configured in such a way that the cover element cannot be moved further along the operating direction when the maximum possible angle of inclination defined by the foot pedal design is reached. In order to make the transition from the first height offset section to the second height offset section more difficult, the actuating device is in particular embodimented in such a way that an additional application of force is required for a transition from the first state to the second state. For example, a restoring force of a spring, whose restoring force in the first height offset section does not counteract a movement of the actuating device, must be overcompensated. In principle, the cover element rests on the actuating device in the central area of the cover element, so that the cover element can be tilted to either side. Furthermore, it is conceivable that the cover element and/or the housing is completely rotationally symmetrical in relation to an axis of symmetry running parallel to the actuating device.

According to a further embodiment of the present disclosure, it is provided that the cover element, when occupying the maximum possible angle of inclination, should rest partially against the housing base. This is an advantageous way of preventing the maximum inclined cover element from being lowered further and thereby carrying the actuating device with it in such a way that the actuating device is transferred to the second height offset section. Preferably it is provided that the foot pedal can take up exactly one position in each possible tilting direction in which the angle of inclination becomes maximum. Furthermore, it is conceivable that the housing base has a circumferential shoulder facing the cover element, against which the inclined cover element comes in abutment when the pre-determinable angle of inclination, for example the maximum angle of inclination, is taken.

Preferably it is provided that the cover element has a limited offset height in the edge area or at the outer circumference, which determines the predeterminable, for example the maximum, angle of inclination. In addition, the maximum angle of inclination is determined by the diameter of the foot pedal. Preferably, the foot pedal or cover element has a diameter between 13 cm and 25 cm. The offset height in the axial direction is limited, for example, by the fact that a collar on the underside of the cover element, directed radially inwards and extending circumferential, engages in a receiving area of the housing that is open radially outwards. This receiving area is preferably limited in a direction parallel to the direction of actuation to one side by projections projecting radially from a housing wall and to the other side by the housing base, in particular the circumferential shoulder of the housing base. The maximum inclined cover element then rests on one side on at least one of the projections and on the other side partially on the housing base.

In an advantageous embodiment of the present disclosure, it is provided that a height offset of the actuating device caused by reaching the predeterminable, for example the maximum, tilt position, is smaller than an extension of the first height offset section. This ensures that the actuating device remains within the first height offset section when the cover element reaches its predeterminable, for example maximum, tilt angle and thereby carries the actuating device along. Here, the first height offset section is measured from a starting position which the cover element occupies when no external force is applied to the cover element.

Preferably it is provided that the actuating device, when occupying the maximum possible angle of inclination of the cover element, is arranged adjacent to the second height offset section. In particular, the cover element rests at least partially against a contact point at the housing base and would have to be swiveled further around this contact point for a further height offset of the actuating device. This is counteracted by the actuating device, which would require additional force for its transfer to the second state, making it more difficult to operate the second switch unintentionally in an advantageous manner. In other words, the cover member acts as a lever arm pivotable about the contact point (at the housing base), on the side of which facing away from the contact point or in the center of which the actuating device is arranged, the actuating device counteracting a continuation of the pivoting movement with a force required for the transfer from the first to the second state. In order to reduce the effort required to continue the pivoting movement, the user must extend the actuating length of the lever arm, which can be pivoted around the contact point, by advancing with the foot further towards the center. Therefore, if the user first actuates the cover element at the edge, i.e. at or near the contact point, the lever length is small and the usual force applied by means of the foot is not sufficient to overcome the reset force of the actuating device which would be required to reach the second state. This results in a radial dependence of a force to be applied for actuating the second switch, according to which a force to be applied for actuating the second switch increases at least linearly from the central region to the edge region with increasing distance from the actuating device.

Furthermore, it is preferably provided that the offset height in the edge region and an extension of the first height offset section are embodimented such that their size ratio limits the arrangement of the actuating device to the first height offset section when the maximum possible angle of inclination of the cover element is reached. Preferably, the extension of the first height offset section is configured depending on the offset height. This prevents the actuating device from entering the second height offset section when the cover element is at maximum inclination. For example, the ratio of the offset height to the extension of the first height offset section is between 0.8 and 1, preferably between 0.9 and 1 and especially preferred between 0.95 and 1.

To determine the extension of the first height section, a protrusion is provided at the housing bottom. In particular, the protrusion is configured in such a way that it comes into contact with an underside of the actuating device in order to transfer the actuating device from the first to the second state. This makes it easy to determine an extension of the first height offset section by adjusting the height of the protrusion accordingly. Preferably, the material from which the protrusion is made differs from the material from which the rest of the housing base is made. In particular, the protrusion is made of a resilient material such as a metal or fiber-reinforced plastic. This is an advantageous way of taking account of the fact that the protrusion is intended as an abutment being exposed to increased loads when the actuating device, resting on the protrusion, is to be transferred to the second state by means of an application of force.

In accordance with a further embodiment of the present disclosure, it is provided that the actuating means is connected to the housing base via a first spring, the actuating device comprising a first element and a second element, a second spring being arranged between the first element and the second element, the actuating device being configured such that during the movement of the actuating device in the first height offset section the first spring is elastically deformed and in the second height offset section the second spring is elastically deformed. The first spring ensures in an advantageous way that the actuating device and the cover element are returned to their original position if no forces act on the cover element. By means of the second spring, it is possible to adjust in particular the force required for the transition of the actuating device from the first state to the second state. In particular, the first element and the second element are pushed together in the second state or at the transition from the first to the second state. Preferably, the second element is mounted longitudinally movable in the first element. For example, first element and second element here are shaped like sleeves or pots and are put one inside the other.

According to another embodiment of the present disclosure, it is provided that a spring force of the second spring is more than twice, preferably more than three times and more preferably five times as large as the spring force of the first spring. This requires a corresponding additional force if the actuating device is to be transferred to the second state in which the second switch is operable. As a result, the probability of accidental actuation of the second switch is further reduced.

Furthermore, it is preferred that the first switch and the second switch are offset in height. This advantageously eliminates the complicated actuation mechanism that would otherwise be required if the first switch and the second switch were located at the same height in the direction of actuation. Preferably, the actuator moves in a space between the first switch and the second switch, which for example face each other.

It is also provided that the housing is configured as an insert in the form of a basic housing body which is connected to the housing base. Preferably, the bottom of the housing is bound to the housing via a magnetic release mechanism. For this purpose, the housing base comprises a magnet which interacts with a magnetic part of the housing or the housing base body. The magnetic release mechanism is preferably located below the actuating device. In particular, a projection, against which the actuator comes into abutment during movement along the direction of actuation, forms the magnetic part of the housing which holds the housing base with its magnets in the assembled state.

The magnetic release mechanism allows the housing base to be easily removed from the housing. Furthermore, the magnetic release mechanism, provided that it is centrally mounted on the housing bottom, as shown in the figures, allows the basic body of the housing and the cover element, connected to it, to rotate around the housing base, which is usually connected to the floor in an adherent manner. For this purpose, the opposing surfaces of the magnet and the magnetic part of the housing, such as the projection, are mounted in such a way that a rotating movement is made possible. Smooth surfaces that slide on top of each other are preferred.

Preferably, the housing on its side facing the housing base is configured in such a way that a compartment for energy storage cells is freely accessible when the housing bottom is separated from the housing. Together with the magnetic release mechanism, it is possible to simplify the replacement of the energy storage cells required regularly to supply the transmitter in the housing.

BRIEF DESCRIPTION OF THE DRAWINGS

Further advantages and characteristics result from the following description of preferred embodiments of the subject-matter of the disclosure with reference to the attached figure. Individual characteristics of the individual embodiment can be combined with each other within the disclosure It shows.

DETAILED DESCRIPTION

Figure 1:
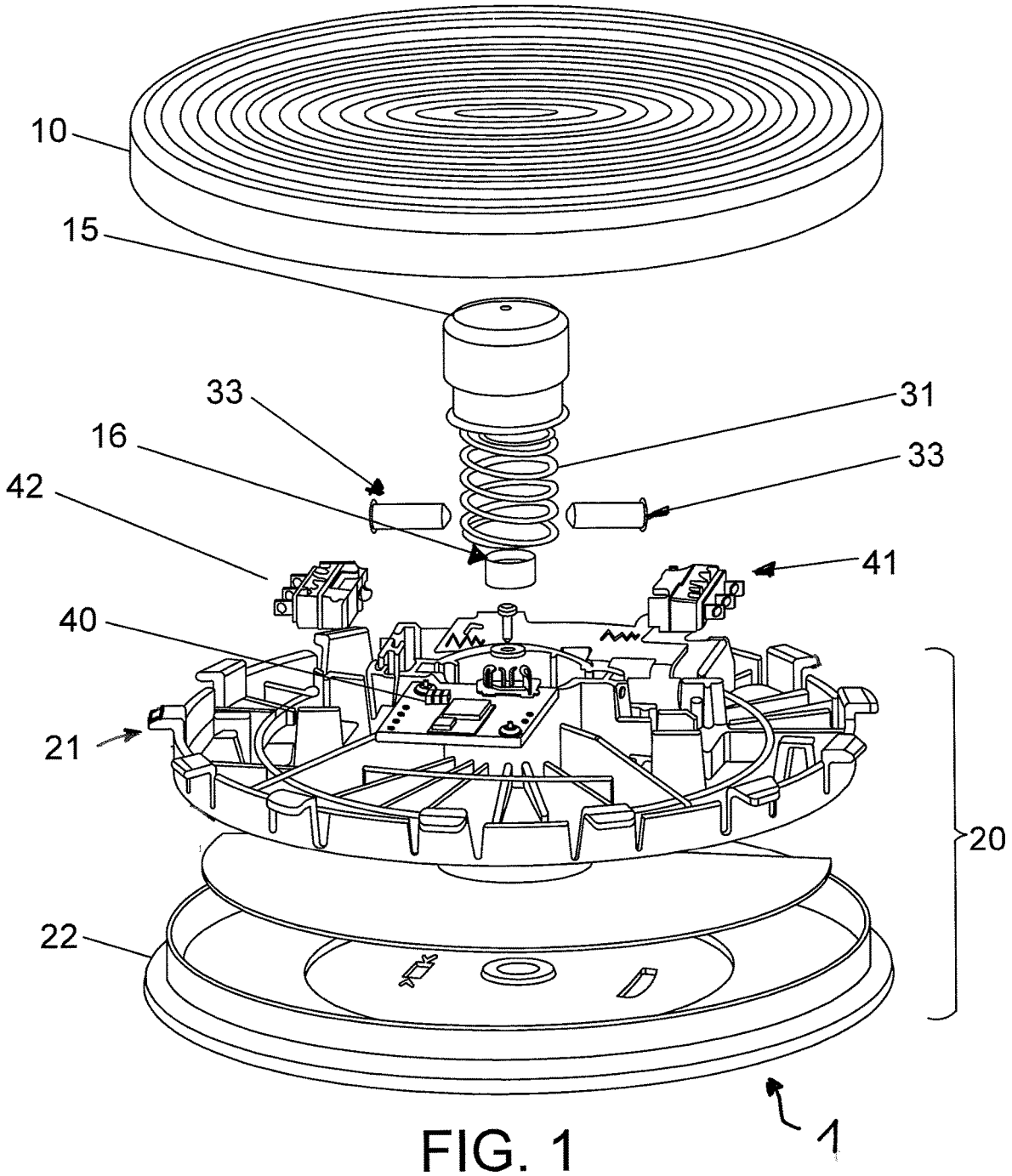
FIG. 1: a schematic exploded view of a foot pedal in accordance with a preferred embodiment of the present disclosure.

FIG. 1 shows a schematic exploded view of a foot pedal 1 according to a preferred embodiment of the present disclosure. In particular, foot pedal 1 is one intended to control a medical device, preferably a dental device. The foot pedal 1 should be used to make settings on the medical device so that the user does not have to interrupt his work, for example a treatment measure on the patient, in order to operate the medical device manually.

In addition to a housing 20 with a housing base 22, an essential component of the embodiment example shown in FIG. 1 is also a cover element 10, which is height-adjustable in relation to the housing base 22 along an actuating direction B and inclinable in relation to the housing base 22. Specifically, the cover element 10 rests centrally on an actuating device 15. By centrally resting on the actuating device 15, the cover element 10 can be tilted or inclined towards all sides and by the contact between the cover element 10 and the actuating device 15, the actuating device 15 is displaced in actuating direction B when a force, in particular with the foot, is applied to the cover element 10, in particular substantially vertically. Here a height offset of the actuating device in actuating direction B can occur both when stepping on the edge area and when stepping on the central area. The disclosure defines height offset as a displacement of the control 15 along the direction of actuation B, which is generally directed essentially vertically from above in the direction of the floor. In order to return the actuator 15 to its initial position, a first spring 31 is provided which is connected on one side to the housing base 22 and on the other side to the actuating device 15, in particular to a first element 51 of the actuating device 15.

Depending on the position and magnitude of the force applied to the cover element 10, there is a difference in the height offset of the actuating device 15, which is caused by the foot stepping on the cover element 10. For example, if a force acts on an edge of the cover element 10, the cover element 10 is tilted about a lever point provided by the actuating device 15 or a lever surface provided by the actuating device 15. In addition to the inclination, a height offset of the height-adjustable mounted actuating device 15 is also initiated. The height offset of the actuating device stepping on the edge area is supported by the fact that during tilting the movement of the cover element on the side opposite to the actuated edge area is limited upwards, i.e. in a direction opposite to the direction of actuation. This means that when the cover element 10 is tilted, the cover element on the opposite side comes into contact with a radial projection 21 in a direction opposite to the direction of actuation, so that the actuating device 15 is carried along by the cover element 10 when the cover element 10 is tilted.

This height offset caused by tilting is, however, smaller than that caused by a force of the same magnitude when the force acts on the cover element 10 above the actuating device 15 and parallel to the direction of actuation B, i.e. more in the central area of the cover element 10. Accordingly, the different height offsets can be used to differentiate between two types of foot pedal 1 actuation, whereby different functionalities can be assigned to the different types of functionalities. In particular, a first functionality can be assigned to stepping on an edge area and the resulting tilting of the cover element 10, and a second functionality can be assigned to stepping on a central area of the cover element.

A reference plane E is defined by the lower edge of the cover element 10 and is essentially parallel to the plane of the floor when unloaded. The predeterminable inclination angle $\alpha$ is the angle between this reference plane E and the plane defined by the lower edge of the cover element 10, which it set when the cover element is tilted (see FIG. 2*c*).

Figure 2A:
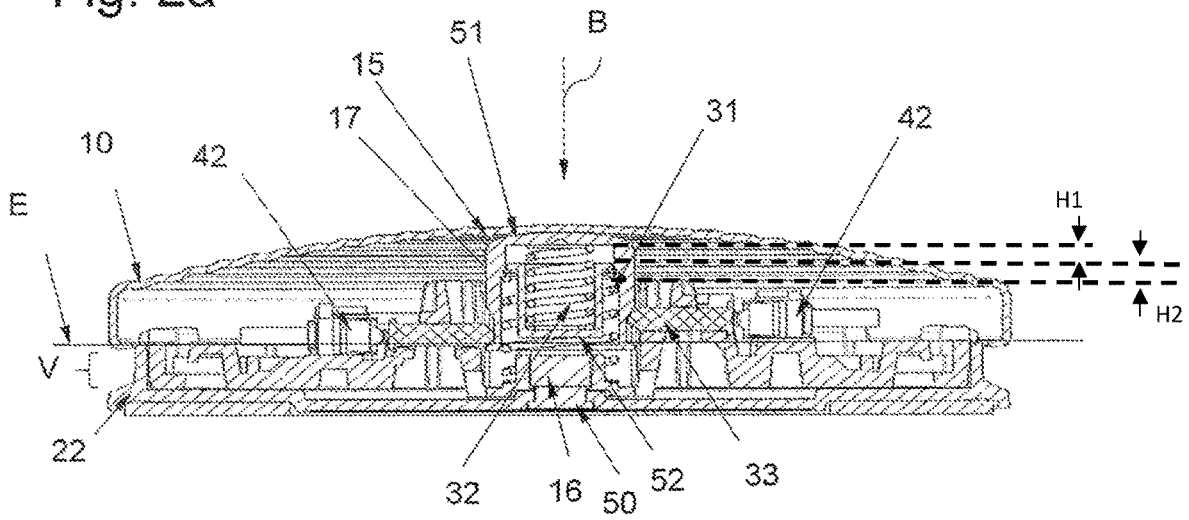
FIGS. 2*a* to 2*d*: Sectional views of the foot pedal from FIG. 1 in different operating states.
Figure 2B:
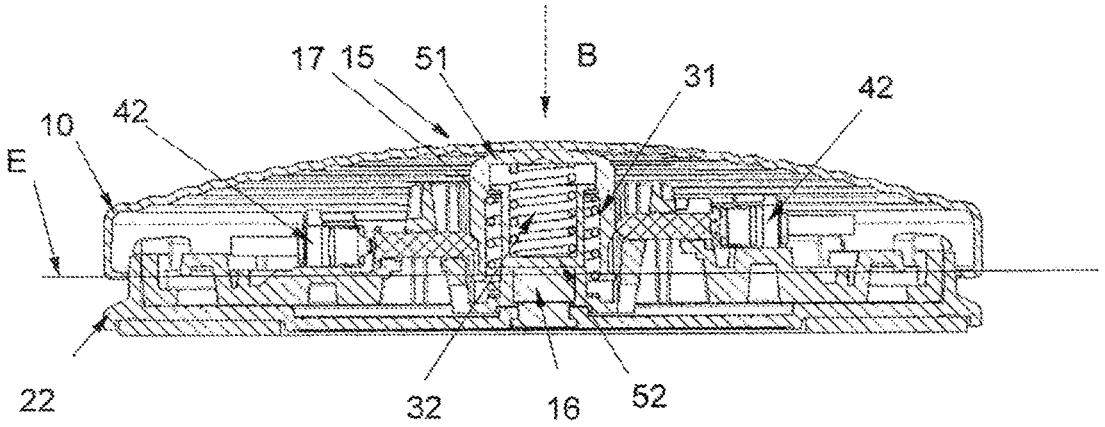
Figure 2C:
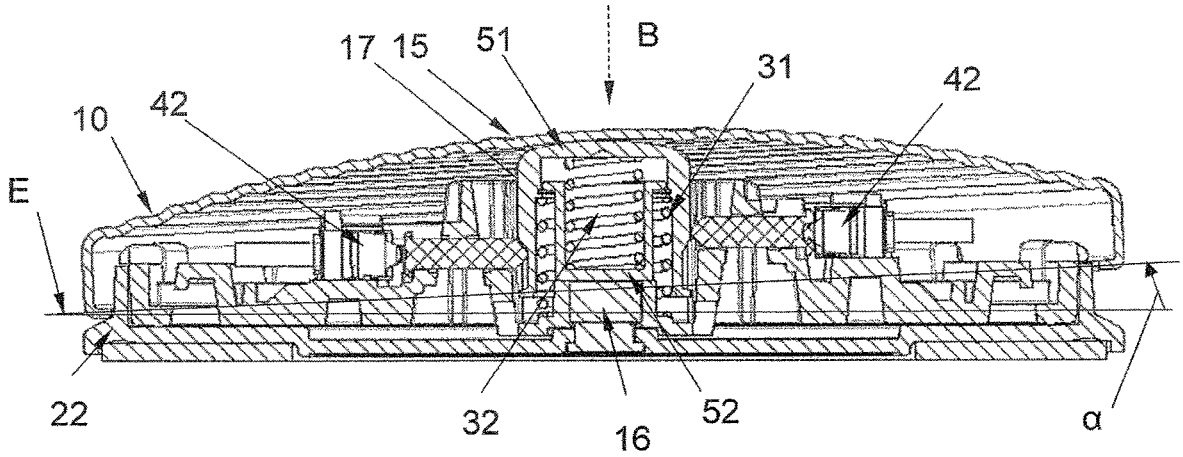

FIGS. 2*a* to 2*d* show sectional views of the foot pedal from FIG. 1 in various operating states. FIG. 2*a* shows the initial position in which the cover element 10 is located if no external force acts on the cover element 10. In order to take advantage of this difference in height offset in the different actuations to differentiate the actuations by the foot, in particular a first switch 41 and a second switch 42 are provided, which are arranged in the housing offset in height with respect to one another, wherein the first switch 41 can be actuated within a first height offset section H1 when the actuating device 15 moves in the actuating direction B and the second switch 42 can be actuated within a second height offset section H2. The second height offset section H2 is directly adjacent to the first height offset section H1 when viewed in the actuating direction B. FIGS. 2*b* and 2*c* show the cover element 10 in the first state, once without tilting or inclination (FIG. 2*b*) and once (FIG. 2*c*) in the first state which typically adjusts when stepping on the edge, namely tilted, with the predeterminable angle of inclination α of the cover element. In both alternatives, the actuating device is always located within the first height offset section H1.

The first switch 41 and the second switch 42 are actuated, for example, by means of pins 33 which can be displaced perpendicularly to the actuating direction B and which are biased by means of spring elements (not shown) against an outside 17 of the actuating device 15, in particular against an outside 17 of a first element 51 of the actuating device 15. The outside 17 of the actuating device 15 has a stepped outer contour, for example in the form of a projection or ramp. When the actuating device 15 moves in actuating direction B, this outer contour interacts with the sliding pins 33 in such a way that the pins 33 are pushed radially outwards away from the side, i.e. along a direction perpendicular to actuating direction B and against a restoring force of the spring elements, so that the pins 33 can actuate the first switch 41 or the second switch 42.

By the fact that the first switch 41 and the second switch 42 are arranged vertically offset from each other, the first switch 41 and the second switch 42 can be switched successively by a movement of the actuating device 15 in the actuating direction B, in particular depending on the respective height offset of the actuating device 15. Together with a transmitting device 40 and a control device, the current status of the foot pedal 1 can be communicated to the medical device. Here the transmitting device is preferably configured such that, when the second switch 42 is actuated immediately after the actuation of the first switch 41, the second functionality is not initiated. This additionally prevents the second functionality from being triggered in the event of an unintentional occurrence on the central area of the operating device, although no triggering or only a triggering of the first functionality by the user is intended.

Alternatively, this function can also be omitted, i.e. the second function is always activated as soon as the second switch 42 has been activated, regardless of a certain period of time between the activation of the first and second switches 41 and 42 respectively. In the case of a further embodiment, no functionality at all is triggered if both switches 41 and 42 are activated immediately one after the other.

In principle, however, there is the danger that the user may achieve a height offset by stepping on the edge area, with which the actuating device 15 moves into the second height offset section and thereby causes the actuation of the second switch 42. In such a situation, the second functionality would be triggered accidentally and unintentionally. In order to counteract inadvertent actuation of the second functionality, it is provided that the actuating device 15 is configured such that an entry into the second height offset range required to actuate the second switch 42 cannot be made by the actuating device 15 only when the actuating means 15 is transferred from a first state to a second state. In particular, it is provided that the transfer of the actuating device 15 from the first state to the second state is linked to an additional application of force. This means that in order to transfer the actuating device to the second state, additional force is required, which must first be applied in order to effect the transition from the first height offset section to the second height offset section.

Figure 2D:
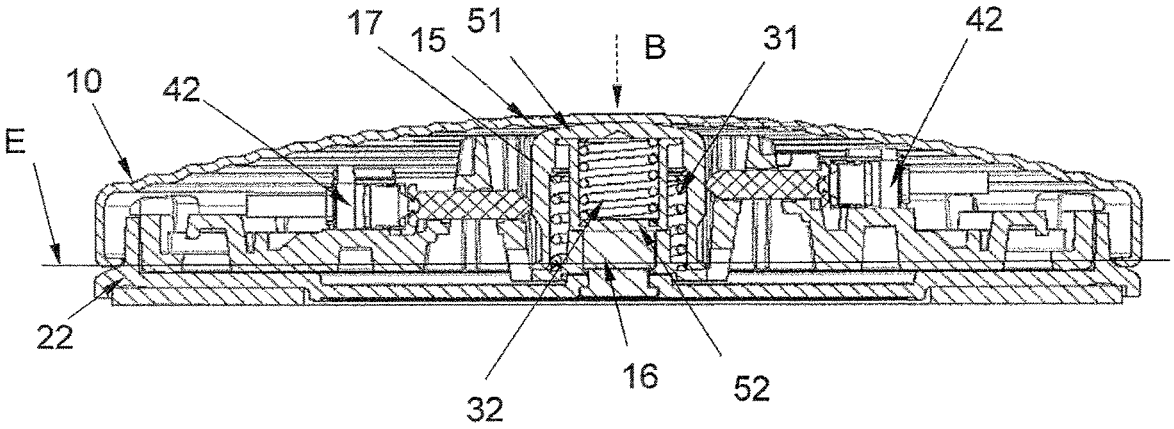

In the example shown, a second spring 32 is arranged between a first element 51 and a second element 52 of the actuating device 15. The first element 51 and the second element 52 of the actuating device 15 are mounted so as to be displaceable relative to each other, wherein in the first state they are kept at a distance from each other by the released second spring 32, i.e. the actuating device 15 is in the first height offset section in a pushed apart state. To convert the actuator 15 to the second state, a force must be applied that overcompensates the restoring force of the second spring 23 and pushes the first element 51 and the second element 52 together. FIG. 2*d* shows the actuating device 15 in its second state. Only by pushing the first element 51 and the second element 52 together a transition from the first height offset section to the second height offset section can be effected for the actuating device 15.

With the second spring 32, additional force can be provided to the operation of the second switch 42 as a condition for a transition from the first height offset section to the second height offset section. However, it cannot be ruled out that, for example, a user may apply so much force to the edge area when stepping on it that this condition is nevertheless met and the actuating device is unintentionally transferred to the second state. In order to counteract this problem, it is planned that the foot pedal 1 is configured in such a way that the actuating device 15 is always arranged within the first height offset section if the cover element 10 occupies the maximum possible angle of inclination α in a tilted state. This means that when the actuating device 15 adopts the predeterminable, for example the maximum angle, of inclination α of the cover element, it is prevented from being transferred from the first state to the second state. The maximum possible inclination angle α is determined by a limited offset height V in the edge area of the cover element 10.

In the concrete embodiment example, this offset height V is limited by the fact that a collar directed radially inwards on the underside of the cover element 10, a) upwards by radial projections 21 directed radially outwards from the housing, and b) downwards by the housing base, in particular by a circumferential shoulder at the housing base is limited in its movement, in a direction extending parallel to the actuating direction B. In order to adopt the predeterminable inclination angle α, the collar rests on one side, e.g. on the housing base 22, and on an opposite side on one of the radial projections 21.

In order to prevent the second state from being reached when the predeterminable angle of inclination, for example the maximum angle of inclination α, is reached, the actuating device 15 is configured in such a way that the height offset is not sufficient to occupy a position in which a transfer to the second state is possible with an additional force acting on the edge region of the cover element 10. In particular, it is provided that the actuating device 15 is configured in such a way that a height offset, which accompanies the alignment of the cover element 10 into the position with the predeterminable, for example the maximum angle of inclination, is smaller than or equal to the first height offset section. For this purpose it is in particular provided that the extension of the first height offset section is correspondingly dimensioned by a distance measured in the actuating direction B between the second element 52 and a protrusion 16 of the housing base 22 arranged below the second element 52. The protrusion 16 serves in particular to support the second element 52 when the first element 51 and the second element 52 are pushed together, i.e. when the actuating device 15 is transferred from the first state to the second state. In other words, without coming into contact with the protrusion 16, the actuating device 15 cannot be transferred to the second state and the actuating device 15 remains within the first height offset section and thus cannot operate the second switch 42.

Thus the protrusion 16, in particular the distance between the protrusion 16 and the second element 52 to be determined in an initial position, determines the extension of the first height offset section. In particular, no further lowering of the actuating device 15 in actuating direction B while maintaining the angle of inclination is conceivable if the cover element 10 is in contact with the housing base 22 when the predeterminable, for example the maximum angle of inclination $\alpha$ is reached. Preferably the actuating device with the second element 52 is in contact with the projection 16 when the cover element 10 is at maximum inclination. In combination with the spring system comprising the first spring 31 and the second spring 32, dimensioning the first height offset portion and the offset height V is established such that, as the distance from the actuator 15 increases in the radial direction, a force to transfer the actuating device 15 to the second state increases, until finally, upon actuating an outer edge region, a transition to the second state is made impossible with normal foot force. In order to reach the second state, the user must direct the force applied to the central area of the cover element 10 accordingly, which reduces or even eliminates the probability of accidentally actuating the second switch 42 when force is applied to the edge area.

Furthermore, it is preferably provided that the housing 20 is configured as an insert in the form of a housing base body which is connected to the housing base 22 and which has the radial projections 21. Preferably, the housing base 22 is bound to the housing 20 via a magnetic release mechanism 50 (FIG. 2*a*). For this purpose, the housing base 22 comprises a magnet which interacts with a magnetic part of the housing 20 or the housing base body. Preferably, the magnetic release mechanism 50 is located below the actuating device 15. In particular, the protrusion 16, against which the actuating device 15 comes into abutment during movement along the direction of actuation B, forms the magnetic part of the housing 20, which holds the housing base 22 with its magnets in the assembled state.

The magnetic release mechanism 50 allows the case base 22 to be easily detached from the housing 20. Furthermore, the magnetic release mechanism 50, when centrally mounted on the housing base 22 as shown in FIG. 2*a*, allows the housing body and the cover element 10 connected to it to rotate about the housing base 22, which is normally adherently connected to the floor. For this purpose, the opposing surfaces of the magnet and the magnetic part of the housing 20, such as the projection 16, are mounted in such a way that a rotating movement is made possible. Smooth surfaces that slide on top of each other are preferred.

Preferably, the housing on its side facing the housing base is configured in such a way that a compartment for energy storage cells is freely accessible when the housing base 22 is separated from the housing 20. Together with the magnetic release mechanism 50, a change of the energy storage cells can be simplified, which is necessary, for example, for the supply of a transmitter in the housing on a regular basis.

The second state cannot be reached if the cover element 10 has adopted the predetermined angle of inclination, in particular the maximum possible a. When this condition is reached and the cover element 10 is pressed with a vertical force away from the edge, the cover element 10 will tilt, i.e. the angle of inclination $\alpha$ decreases again until it finally triggers stage two with the abutment at the bottom of the housing 22 as pivot point.

In other words: the tilting possibility according to the disclosure having an abutment, i.e. with the maximum possible angle of inclination, ensures that only switch 41 is activated when force is applied to the edge (this is always the case when the user's foot is placed on the side because this edge protrudes). When the cover element 10 has reached the edge at one point, other basic conditions apply to the lever forces. The pivot point moves (jumps) from the opposite point of the cover element 10, i.e. from the radial projections 21 to the abutment, i.e. where the cover element 10 rests against the housing base 22. The cover element 10 can now only be pressed further downwards, i.e. the angle of inclination $\alpha$ decreases when the force behind the pivot point, i.e. between the stop and the opposite side, is applied. Since the upper edge of the cover element 10 is above or even behind, i.e. on the side of the new pivot point facing away from the Centre, the cover element 10 cannot be moved any further.

A preferred embodiment is explained below:

Central activation: The central restoring forces are taken over by the two springs 31, 32. Spring 31 has a spring constant of about 1 N/mm and a preload of 20 N. At a central force of e.g. 22.5 N, the cover element is pressed down 10 2.5 mm and triggers the first switch 41. If the cover element 10 is loaded further, the second spring 32 is pressed in parallel at 3 mm and 23 N additional. This spring has a spring constant of 5 N/mm and is preloaded with 25 N. To press in the cover element 10 3.1 mm, a force of 48.6 N (23.1 N+25.5 N) must be applied. The second switch 42 is activated at 5.3 mm. This requires a force of 61.8 N (25.3 N+36.5 N). The total compressible distance, i.e. the sum of the first and second height offset sections, is limited to approx. 5.5 mm. Then the cover element 10 is placed on the outside of the housing base 22. This force diagram applies when the foot pedal is actuated centrally.

Decentralized activation: When the cover element 10 is loaded at the outer lateral edge (pressure point), the forces opposing the foot force are significantly lower. In the case of a fixed diameter of the cover element 10, the restoring forces can be calculated according to the lever law, whereby the pivot point is to be assumed exactly opposite the pressure point, i.e. at the contact point of the collar of the cover element 10 on one of the projections 21 and the spring force acts in the Centre of the lever, i.e. in the area of the actuating device 15. This halves the necessary forces from the above calculation, whereby the distance covered (at the outer edge) becomes twice as long. If the foot pedal is now pressed so far that the cover element 10 strikes the housing base 22 on the loaded side, a distance of 5.5 mm is covered, the force required for this is approx. 11.4 N and the first switch 41 is released. The second spring 32 is not yet loaded. The lower element 52 then rests exactly on the projection 16. By pressing further on the outer lateral edge, the second switch

42 cannot be released for geometrical reasons, as explained above. To trigger the second switch 42, a pressure point is required on the cover element 10, i.e. at a distance from the edge of the cover element 10, and not on its edge. The trigger values for the second switch 42 can be calculated depending on the diameter of the cover element 10 and the position of the pressure point. Due to the lever, the values are lowest at 61.8 N with a central actuation (see above calculations) and increase significantly with the distance of the pressure point from the Centre of the cover element. At the edge of the cover element 10, these go into infinity, mathematically speaking, since the force acts vertically on the pivot point. With an embodiment according to the example above and a diameter of the cover element 10 of 15 cm, the tripping force for the second switch 42 at a pressure point at a distance of e.g. 2 cm from its edge is still 232 N. With such a high value, unintentional triggering is virtually impossible. The user is therefore forced to operate the foot pedal as centrally as possible in order to activate the second function. On the other hand, the first function can be triggered at any point of the cover element 10 with low forces of 11.4 to 22.8 N (depending on the pressure position).

A typical foot pedal according to the disclosure has a diameter of 13-25 cm and a crown height of approx. 4 cm.

The invention claimed is:

1. A foot pedal for controlling a medical device, in particular a dental device, comprising a housing with a housing base, a cover element which is mounted so as to be vertically displaceable with respect to the housing base along an actuating direction and so as to be inclinable with respect to the housing base, a first switch for initiating a first functionality on the medical device and a second switch for initiating a second functionality on the medical device, and an actuating device which is vertically displaceable along an actuating direction and which actuates the first switch during a movement in the actuating direction within a first height offset section and actuates the second switch within a second height offset section, the actuating device being configured in such a way, in that it is in a first state in the first height offset section and in a second state in the second height offset section, wherein the foot pedal being configured such that, at a predeterminable angle of inclination of the cover element, the actuating device is always arranged within the first height offset section;

wherein the actuating device is connected to the housing base via a first spring, wherein the actuating device comprises a first member and a second member, wherein a second spring is arranged between the first member and the second member, wherein the actuating device is configured such that, when the actuating device moves in the first height offset section, the first spring is deformed elastically and, in the second height offset section, the second spring is deformed elastically.

2. The foot pedal according to claim 1, wherein a predeterminable angle of inclination is a maximum possible angle of inclination of the cover element which is defined on one side by the cover element resting at least partially on the housing base and on an opposite side by the cover element resting against at least one radial projection of the housing.

3. The foot pedal according to claim 2, wherein the offset height in the edge region and the first height offset section are configured such that a size ratio limits an arrangement of the actuating device to the first height offset section when reaching the maximum possible angle of inclination of the cover element.

4. The foot pedal according to claim 3, wherein the size ratio of the offset height in the edge region to the extension of the first offset height section is between 0.8 and 1.

5. The foot pedal in accordance with claim 1, wherein the cover element has a limited offset height in an edge region which determines the predeterminable angle of inclination.

6. The foot pedal according to claim 1, wherein the actuating device is arranged adjacent to the second height offset portion when reaching a maximum possible inclination angle of the cover member.

7. The foot pedal according to claim 1, wherein the housing has a protrusion below the actuating device, wherein the protrusion defines an extent of the first height offset portion.

8. The foot pedal according to claim 1, wherein a spring force of the second spring is more than twice as great as a spring force of the first spring.

9. The foot pedal according to claim 1, wherein the first switch and the second switch are height offset from each other.

* * * * *